US006396035B2

(12) United States Patent
Shon et al.

(10) Patent No.: US 6,396,035 B2
(45) **Date of Patent: *May 28, 2002**

(54) MICROWAVE OVEN AND DATA OBTAINING METHOD THEREFOR

(75) Inventors: Jong-chull Shon, Suwon; Won-woo Lee, Ansan; Tae-soo Park, Suwon; Joon-young Jeong, Seoul, all of (KR)

(73) Assignee: SamSung Electronics, Co., Ltd., Suwon (KR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/480,857

(22) Filed: Jan. 11, 2000

(30) Foreign Application Priority Data

Jan. 14, 1999 (KR) ..... 1999-762
Jul. 7, 1999 (KR) ..... 1999-27330

(51) Int. Cl.[7] ..... H05B 6/68; H05B 6/78

(52) U.S. Cl. ..... 219/702; 219/704; 219/708; 219/709; 219/754; 99/325

(58) Field of Search ..... 219/702, 703, 219/709, 708, 707, 706, 704, 705, 710, 754, 716; 99/451, 325

(56) References Cited

U.S. PATENT DOCUMENTS

| | | | | | |
|---|---|---|---|---|---|
| 4,210,795 | A | * | 7/1980 | Lentz | 219/709 |
| 4,281,022 | A | * | 7/1981 | Buck | 219/707 |
| 4,317,977 | A | * | 3/1982 | Buck | 219/709 |
| 4,507,531 | A | * | 3/1985 | Teich et al. | 219/702 |
| 4,870,238 | A | * | 9/1989 | Hodgetts et al. | 219/706 |
| 5,293,019 | A | * | 3/1994 | Lee | 219/708 |
| 5,558,797 | A | * | 9/1996 | Takagi | 219/707 |
| 5,565,655 | A | * | 10/1996 | Jeon | 219/708 |

FOREIGN PATENT DOCUMENTS

| | | | |
|---|---|---|---|
| AU | 61662/80 | | 8/1980 |
| JP | 63-197820 | * | 8/1988 |
| JP | 08159481 | | 6/1996 |

* cited by examiner

*Primary Examiner*—Philip H. Leung
(74) *Attorney, Agent, or Firm*—Robert E. Bushnell, Esq.

(57) ABSTRACT

A data obtaining method for a microwave oven for processing a cooking status of food detected by a sensor into data, including the steps of: detecting data from food for a predetermined time period; calculating a summation of the detected data; and subtracting data about characteristics of the microwave oven which are prestored in the microwave oven from the detected data.

12 Claims, 7 Drawing Sheets

ENERGY ABSORPTION
FOODSTUFF CHARACTERISTIC CURVE
TEMPERATURE
S(1)

OUTPUT
MAGNETRON CHARACTERISTIC CURVE
TIME
S(1)
t2

MICROWAVE ABSORPTION RATE
COOKING CHAMBER CHARACTERISTIC CURVE
TIME
S(1)
t1

DETECTED VOLTAGE
A
B
C
t3
S(1) TIME

MICROWAVE OVEN AND DATA OBTAINING METHOD THEREFOR

BACKGROUND OF THE INVENTION

1. Field of the Invention

The present invention relates to a data obtaining method for a microwave oven, and more particularly to a data obtaining method for a microwave oven for obtaining data about food in the microwave oven so as to control a cooking operation of the microwave oven with respect to the food therein.

2. Description of the Prior Art

Generally, a microwave oven performs cooking operation by radiating microwaves generated from a magnetron onto food, which is a dielectric substance, in the microwave oven. That is, the microwaves collide molecules in the food and generate fictional heat for heating the food.

In such a microwave oven, a user places food on a turntable in a cooking chamber of the microwave oven, and manipulates function buttons on a control panel attached on a front side of the microwave oven to perform his/her desired cooking operation. Then, a control section of the microwave oven performs the cooking operation while adjusting a level of output power of the magnetron and cooking time in accordance with preset cooking data.

Recently, in order to meet increasing demands of the users for various cooking functions, there are a plurality of cooking item preset data corresponding to various foods and cooking purposes. Accordingly, the preset data corresponding to the user's selected foods, that is, cooking items are loaded to adjust the power level of the magnetron and cooking time of the microwave oven, and the desired cooking operation is performed. Here, the user selects his/her desired foodstuff among a plurality of selectable cooking items by manipulating a plurality of cooking item buttons.

Further, when defrosting the frozen food or warming the refrigerated food in the microwave oven, the user selectively inputs the weight of the food, or defrosting or warming time by himself/herself.

Despite a plurality of cooking item preset data corresponding to the various foods and cooking purposes, the conventional microwave oven has a shortcoming in that the microwave oven cooks the food simply according to the preset data of the corresponding cooking item, regardless of actual status, i.e., the actual food and quantity of the food received in the microwave oven. Accordingly, the microwave oven hardly achieves proper cooking.

Further, in the conventional microwave oven, since there have to be a plurality of cooking item buttons for inputting execution commands for a plurality of cooking items, and also a complicated cooking algorithm corresponding to the manipulation of a plurality of the cooking item buttons, the manufacturing cost increases, while the user has inconvenience for finding his/her desired button among a plurality of the cooking time buttons.

Meanwhile, when the user inputs the cooking time by himself/herself for defrosting or warming operation, since the user inputs the cooking time solely by his/her guesswork, the actual frozen or refrigerated degree of the food is not considered, and the precise defrosting or warming operation cannot be expected.

Further, since the conventional microwave oven performs the cooking operation without considering the characteristics of the microwave oven, such as an output power changing characteristics of the magnetron, an energy loss absorbed in the cooking chamber, etc., the precise analysis about the characteristics and the changing degrees of the food cannot be achieved, and the cooking is improperly performed.

SUMMARY OF THE INVENTION

The present invention has been developed to overcome the above-mentioned shortcomings of the prior art, and accordingly, it is an object of the present invention to provide a data obtaining method for a microwave oven for converting the food characteristics into data which is used as basic data for determining type of food and physical status of the food.

Another object of the present invention is to provide a data obtaining method for a microwave oven for averaging a plurality of data detected by a sensor for a certain cooking period, and for determining the type of food and physical status of the food in accordance with the averaged results.

Yet another object of the present invention is to provide a data obtaining method for a microwave oven for calculating data about physical status change of food only while considering the characteristic change of the microwave oven.

The above objects are accomplished by a data obtaining method for a microwave oven according to the present invention, including the steps of: (a) detecting data from food for a predetermined time period; and (b) calculating a summation of the detected data.

The summation of the detected data is averaged.

The detected data are comprised of data detected by a sensor during every 1 rotation period of a turntable of the microwave oven.

Another object is accomplished by a data obtaining method for a microwave oven according to another preferred embodiment of the present invention, including the steps of: (a) detecting data from food from a sensor; and (b) subtracting data about characteristics of the microwave oven which are prestored in the microwave oven from the detected data.

The detected data from the sensor are comprised of data which are detected during every 1 rotation period of a turntable of the microwave oven.

The data about the characteristics of the microwave oven are comprised of data about characteristics of output power of a magnetron of the microwave oven, and energy absorption characteristics in a cooking chamber of the microwave oven.

Another object is accomplished by a data obtaining method for a microwave oven according to yet another preferred embodiment of the present invention, including the steps of: (a) detecting data from food for a predetermined time period; (b) calculating a summation of the detected data; and (c) subtracting data about characteristics of the microwave oven which are prestored in the microwave oven from the summation of the detected data.

As described above, according to the present invention, by regularly detecting the characteristic data about the food in the microwave oven, and by averaging the detected data, the types of the food and the physical status change of the food according to the time progress can be analysed, and especially, the characteristic data about food only can be obtained by subtracting the data about the characteristics of the microwave oven from the detected data from the sensor. As a result, the appropriate food cooking can be achieved.

BRIEF DESCRIPTION OF THE DRAWINGS

Above object and advantage will be more apparent by describing the present invention with reference to the reference drawing accompanied, in which.

DETAILED DESCRIPTION OF THE PREFERRED EMBODIMENT

Hereinafter, a microwave oven according to a first preferred embodiment of the present invention will be described in greater detail with reference to the accompanying drawings.

Figure 1:
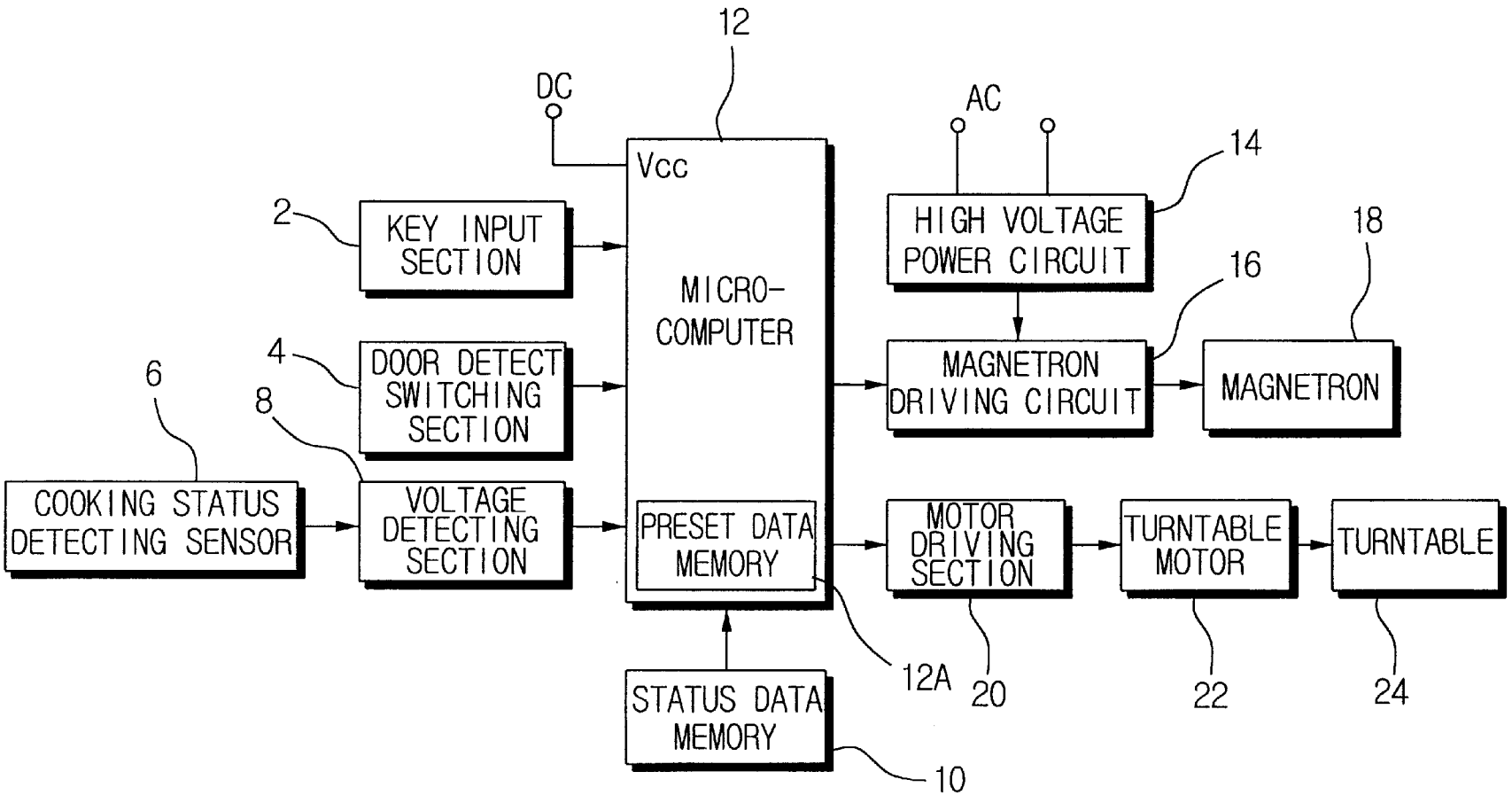
FIG. 1 is a block diagram for showing the structure of a microwave oven employing a data obtaining method according to the present invention.

FIG. 1 is a block diagram for showing the structure of a microwave oven employing a data obtaining method according to the present invention. As shown in FIG. 1, the microwave oven according to the present invention includes a key input section 2 having a plurality of function buttons for inputting the user's selections among various cooking items and cooking operation execution commands, and a door detect switching section 4 for detecting opening/closing status of the cooking chamber door of the microwave oven, and for generating the detected result in the form of a switching signal.

Further, the microwave oven includes a cooking status detecting sensor 6 for detecting cooking status of the food, and a voltage detecting section 8 for precisely detecting the voltage signal from the cooking status detecting sensor 6.

Further, the microwave oven according to the present invention includes a status data memory 10 in which the data detected by the cooking status detecting sensor 6 and the calculation thereof are stored.

Further, the microwave oven includes a microcomputer 12 for calculating based on the data detected by the cooking status detecting sensor 6, and for controlling the level of output power of the magnetron 18 in accordance with the calculation thereof.

The microcomputer 12 includes a control program having a control algorithm for adjusting the output power of the magnetron 18, and for calculating based on the detected data from the cooking status detecting sensor 6, and a preset data memory 12A in which the preset data about the various foods and physical status change of the food are stored.

Further, the microwave oven according to the present invention includes a magnetron driving circuit 16 for receiving the high voltage generated by the high voltage power circuit 14 and for driving the magnetron 18 under the control of the microcomputer 12, and a motor driving section 20 for rotatably driving the turntable motor 22 so as to rotate the turntable 24 at a certain constant speed.

The microwave oven according to a first preferred embodiment of the present invention will be described in greater detail with reference to the accompanying drawings.

Figure 2:
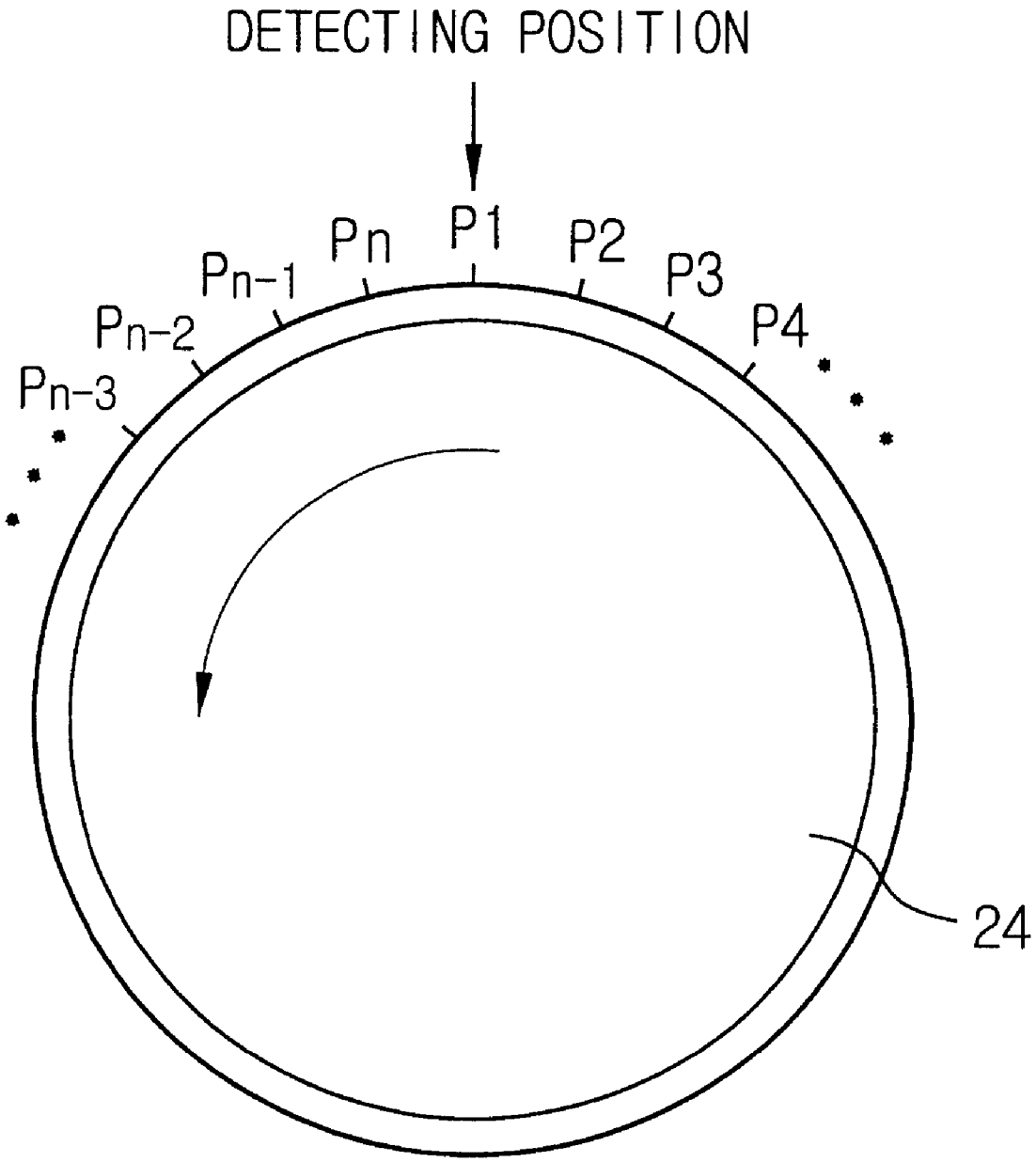
FIG. 2 is a view for showing detecting positions for detecting cooking status of the food during the rotation of a turntable according to a preferred embodiment of the present invention.

According to the first preferred embodiment of the present invention, as shown in FIG. 2, during the rotation of the turntable 24, the microcomputer 12 detects voltage signals obtained from the cooking status detecting sensor 6 from a plurality of detecting positions ($P_1$, $P_2$, $P_3$, $P_4$, . . . , $P_{n-3}$, $P_{n-2}$, $P_{n-1}$, $P_n$) formed along the circumference of the turntable 24.

Here, the microcomputer 12 powers on/off the magnetron 18 regularly, i.e., during every rotation of the turntable 24, and regularly detects the voltage signal data from the cooking status detecting sensor 6 during every power-on period of the magnetron 18. Here, it is preferable that the microcomputer 12 power on/off the magnetron 18 during every three rotations of the turntable 24, and regularly detect the data during every power-on period of the magnetron 18.

Meanwhile, one rotation of the turntable 24 preferably takes approximately 10 seconds. Accordingly, one power-on/off period of the magnetron 18, i.e., the three rotations of the turntable 24, takes 30 seconds.

Figure 3:
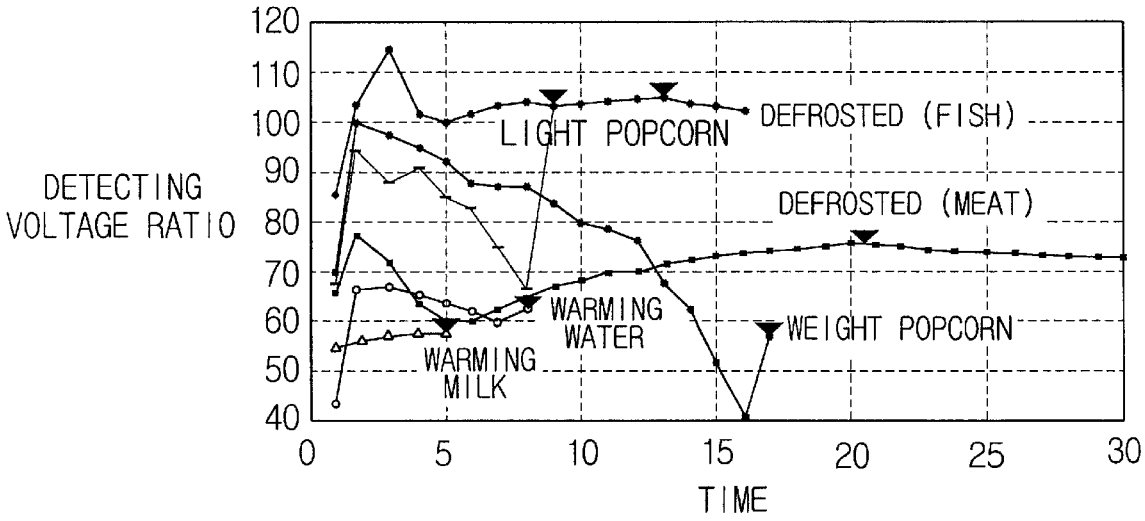
FIG. 3 is a waveform for showing physical status change of various foods based on the data obtained according to the preferred embodiment of the present invention.

The preset data stored in the preset data memory 12A are the tabled data which are obtained through repetitious experiments on the various foods. As shown in FIG. 3, such preset data show the change of detected voltage in accordance with the various foods such as light and weight popcorn, defrosting fish and meat, warming water and milk, etc.

The microcomputer 12 calculates a summation of data regularly detected from the cooking status detecting sensor 6 from a plurality of detecting positions ($P_1$, $P_2$, $P_3$, $P_4$, . . . , $P_{n-3}$, $P_{n-2}$, $P_{n-1}$, $P_n$) formed along the turntable 24, and obtains the final data by averaging the data summation.

Further, the microcomputer 12 determines the type of food and change of physical status of the food by comparing the above finalized data with the preset data about the food, and the tabled data about change of the physical status of the food prestored in the preset data memory 12A.

Figure 4:
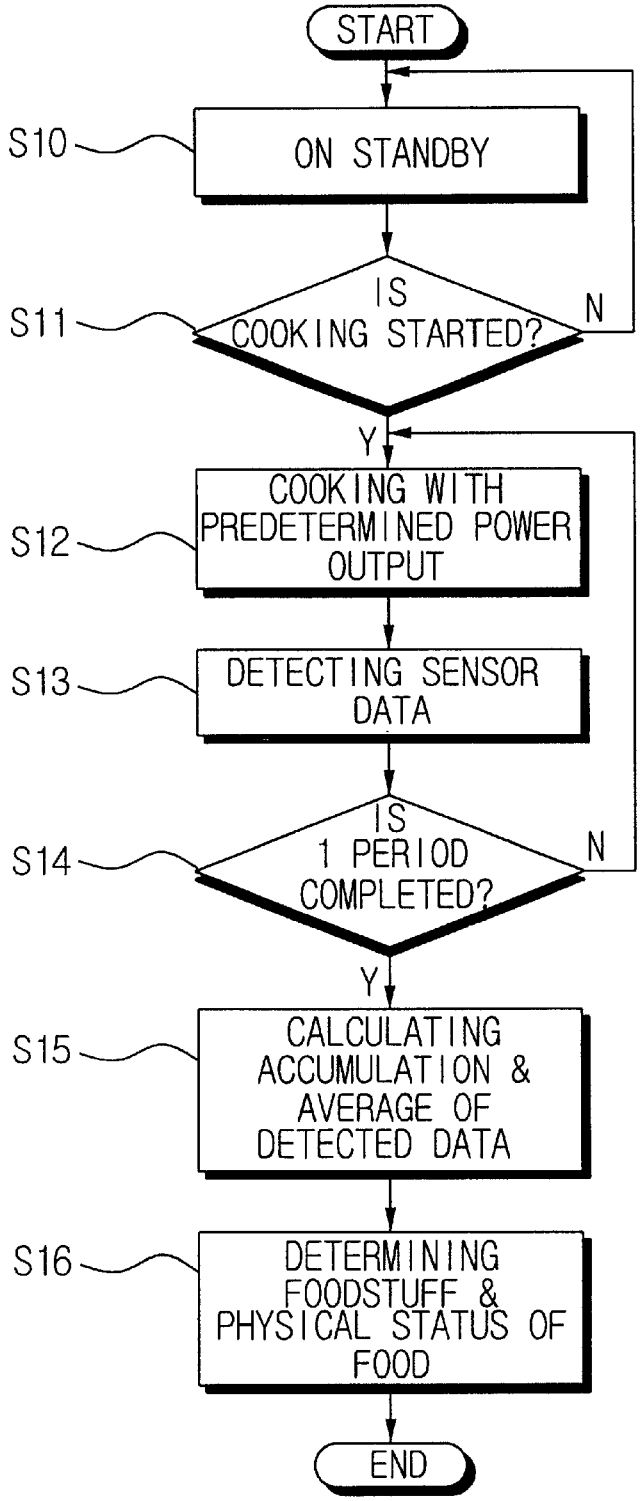
FIG. 4 is a flow chart for explaining the data obtaining method for the microwave oven according to a first preferred embodiment of the present invention.

The operation of the microwave oven according to the first preferred embodiment of the present invention will be described in greater detail with reference to the flow chart of FIG. 4.

First, a user places the food in the cooking chamber of the microwave oven, and the door detect switching section 4 generates the switching signal corresponding to the closing status of the cooking chamber door. The microcomputer 12 receives the door detect switching signal from the door detect switching section 4 and accordingly sets the microwave oven on standby (step S10).

In such a situation, the microcomputer 12 determines whether or not there is a key input for executing the cooking operation from the key input section 2 (step S11).

When determining the presence of a key input for the cooking operation, the microcomputer 12 drives the magnetron driving circuit 16 so that the magnetron 18 generates the microwaves of a predetermined degree. Simultaneously, the microcomputer 12 drives the motor driving section 20 so as to rotatably drive the turntable motor 22, and thus, the turntable 24 is rotated at a predetermined constant speed (step S12).

In such a situation, the microcomputer 12 regularly receives the voltage signals about the cooking status of the food detected by the cooking status detecting sensor 6 from a certain detecting position through the voltage detecting section 8, and thus collects the data (step S13).

Here, the magnetron 18 is powered on/off during every turntable rotation period comprised of three rotations of the turntable 24, and the microcomputer 12 detects the data during every magnetron power-on period.

Meanwhile, the microcomputer 12 determines whether or not the 1 turntable rotation period corresponding to three rotations of the turntable 24 is completed (step S14).

When the microcomputer 12 determines the completion of the 1 turntable rotation period, the microcomputer 12 calculates a summation and averages the data detected during the 1 turntable rotation period (step S15).

The microcomputer 12 determines the type of food and change of physical status of the food by comparing the averaged data with the data about the food and change of physical status of the food stored in the preset data memory 12A, and outputting the most approximate value of the averaged data (step S16).

The microwave oven according to the second preferred embodiment of the present invention will be described in greater detail with reference to the accompanying drawings.

According to the second preferred embodiment of the present invention, the level of the output power of the magnetron considerably increases during the initial stage of the magnetron power-on period of the 1 turntable rotation period, while the stable generation of the microwaves is achieved after a predetermined time period.

Meanwhile, the excessive increase of output power level of the magnetron 18 regularly occurs on every initial stage of the magnetron power-on period of the 1 turntable rotation period. Accordingly, the data detected in the microcomputer 12 includes the excessive change of the output power level even when the data are detected after the power-on of the magnetron 18 at a predetermined time interval.

Here, among the data detected from the cooking status detecting sensor 6 during the 1 turntable rotation period, the microcomputer 12 calculates the change of the physical status of food only, while subtracting the data about the output power characteristics of the magnetron 18, and the energy absorption in the cooking chamber of the microwave oven.

Meanwhile, in the preset data memory 12A, a control program is stored to calculate the status of food only, considering the output power characteristics of the magnetron 18, and the energy absorption in the cooking chamber of the microwave oven. Further, in the preset data memory 12A, characteristic data about the output power characteristics of the magnetron 18 and the energy absorption in the cooking chamber of the microwave oven are stored.

FIGS. 5A to 5D are waveforms for showing obtained data about the characteristics of food only, considering the power change of magnetron and energy absorption in the cooking chamber according to a second preferred embodiment of the present invention.

Referring to FIGS. 5A to 5D, according to the second preferred embodiment of the present invention, during the 1 turntable rotation period, the characteristic data about the output power characteristics of the magnetron 18 (see FIG. 5B), and the characteristic data about the energy absorption in the cooking chamber of the microwave oven (see FIG. 5C) stored in the preset data memory 12A are subtracted from the food characteristic data (see FIG. 5A) detected from the cooking status detecting sensor 6.

Figures 5A, 5B, 5C, 5D:
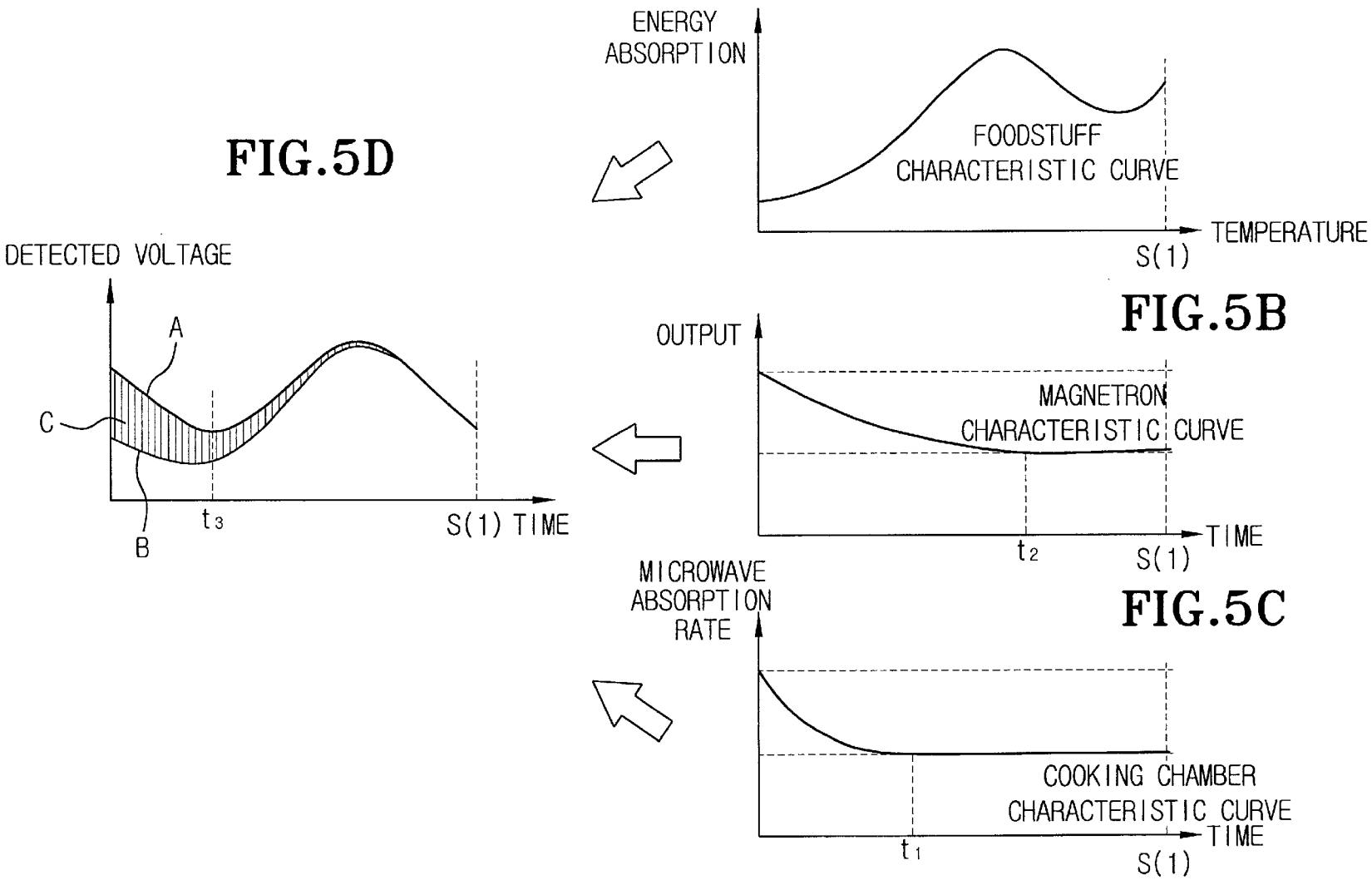
FIGS. 5A to 5D are waveforms for showing obtained data about the characteristics of food only, considering the power change of magnetron and energy absorption in the cooking chamber according to a second preferred embodiment of the present invention.

As shown in FIG. 5D, there is an error range C defined between a first characteristic curve A of data about the output power characteristics of the magnetron 18, and the energy absorption in the cooking chamber of the microwave oven, and a second characteristic curve B of the data subtracting the data about the output power characteristics of the magnetron 18, and the energy absorption in the cooking chamber of the microwave oven. According to the second preferred embodiment of the present invention, the inaccurate data of the first characteristic curve A are converted into the precise data by the second characteristic curve B, narrowing the error range C.

Figure 6:
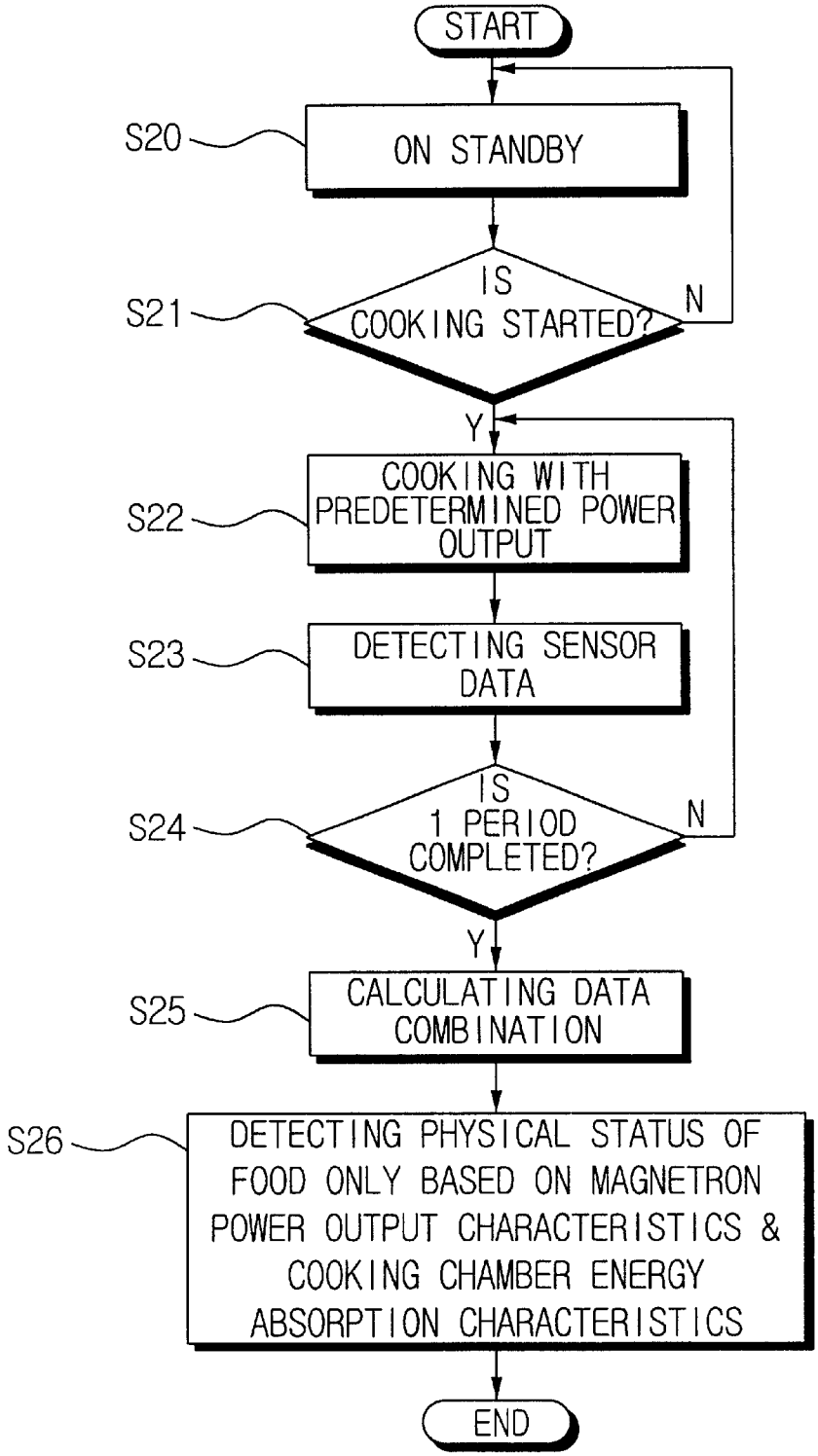
FIG. 6 is a flow chart for explaining a data obtaining method for a microwave oven according to the second preferred embodiment of the present invention.

The operation of the microwave oven according to the second preferred embodiment of the present invention will be described in greater detail below with reference to the flow chart of FIG. 6.

First, a user places the food in the cooking chamber of the microwave oven, and the door detect switching section 4 generates the switching signal corresponding to the closing status of the cooking chamber door. The microcomputer 12 receives the door detect switching signal from the door detect switching section 4 and accordingly sets the microwave oven on standby (step S20).

In such a situation, the microcomputer 12 determines whether or not there is a key input for executing the cooking operation from the key input section 2 (step S21).

When determining the presence of key input for the cooking operation, the microcomputer 12 drives the magnetron driving circuit 16 so that the magnetron 18 generates the microwaves of a predetermined degree. Simultaneously, the microcomputer 12 drives the motor driving section 20 so as to rotatably drive the turntable motor 22, and thus, the turntable 24 is rotated at a predetermined constant speed (step S22).

In such a situation, the microcomputer 12 regularly receives the voltage signals about the cooking status of the food detected by the cooking status detecting sensor 6 from a certain detecting position through the voltage detecting section 8, and thus detects the data (step S23).

Here, the magnetron 18 is powered-on during every 1 turntable rotation period comprised of three rotations of the turntable 24, and the microcomputer 12 detects the data during every magnetron power-on period of 1 turntable rotation period.

Meanwhile, the microcomputer 12 determines whether or not the 1 turntable rotation period corresponding to three rotations of the turntable 24 is completed (step S24).

When determining the completion of the 1 turntable rotation period, the microcomputer 12 calculates the data detected by the cooking status detecting sensor 6 during the 1 turntable rotation period, including the data about the characteristics of food only and also the output power characteristics of the magnetron 18, and the energy absorption in the cooking chamber of the microwave oven (step S25).

In this situation, the microcomputer 12 accesses the preset data memory 12A, and reads the characteristic data about the output power characteristics of the magnetron 18, and the energy absorption in the cooking chamber of the microwave oven.

Next, as shown in FIGS. 5A to 5D, the microcomputer outputs the characteristic data about the physical status change of food only, while subtracting the characteristic data about the output power characteristics of the magnetron 18, and the energy absorption in the cooking chamber of the microwave oven (step S26).

Figure 7:
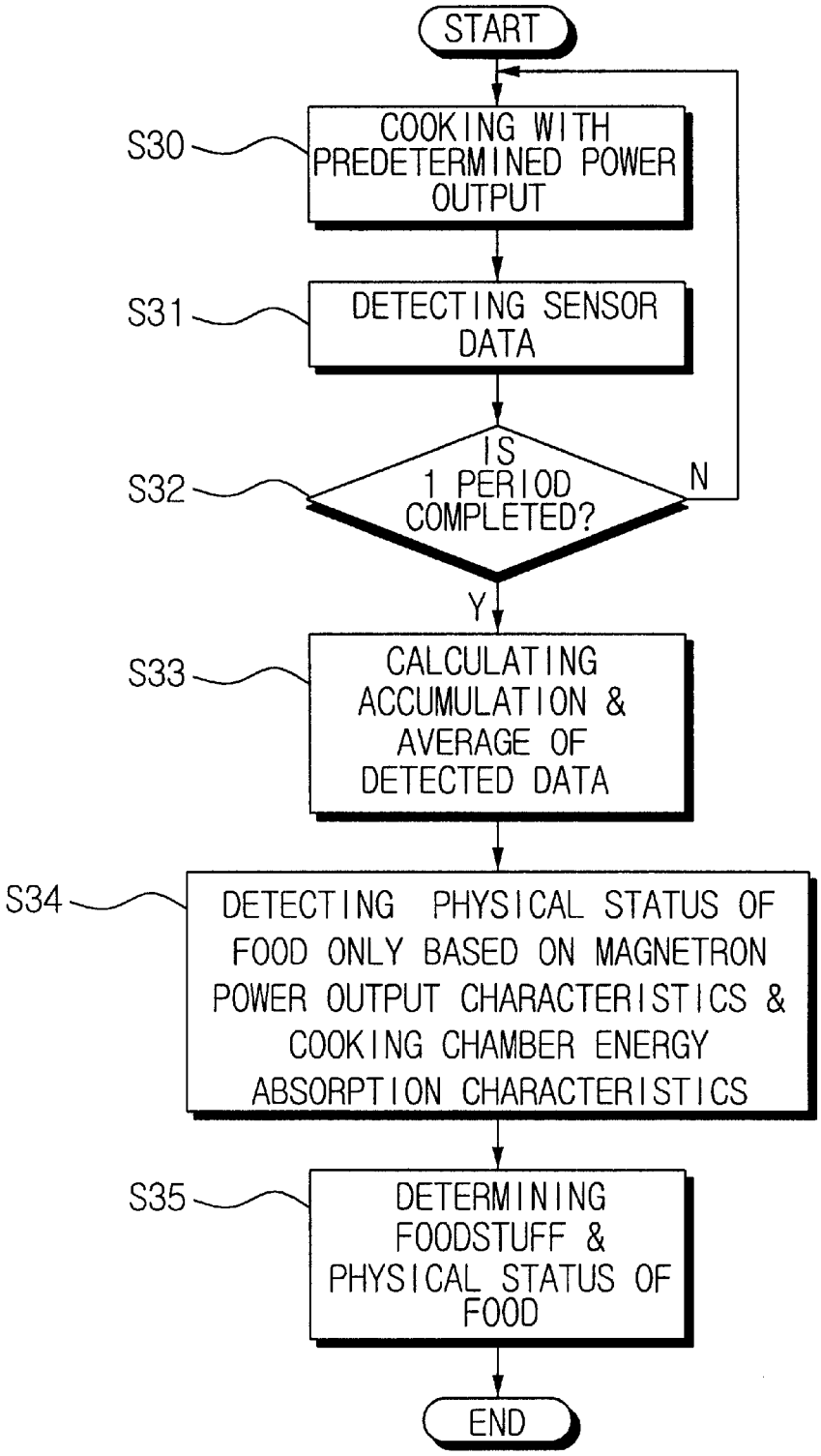
FIG. 7 is a flow chart for explaining a data obtaining method for a microwave oven according to a third preferred embodiment of the present invention.

The microwave oven according to the third preferred embodiment of the present invention will be described in greater detail below with reference to the flow chart of FIG. 7.

First, the microcomputer 12 drives the magnetron driving circuit 16 for generating the microwaves of a predetermined degree from the magnetron 18. Simultaneously, the microcomputer 12 also drives the motor driving section 20 for rotating the turntable 24, on which the food is placed, and the turntable 24 is rotated at a certain constant speed (step S30).

In such a situation, the microcomputer 12 regularly receives the voltage signals about the cooking status of the food detected by the cooking status detecting sensor 6 from a certain detecting position through the voltage detecting section 8, and thus detects the data (step S31).

Meanwhile, the microcomputer 12 determines whether or not the 1 turntable rotation period corresponding to three rotations of the turntable 24 is completed (step S32).

When the microcomputer 12 determines the completion of the 1 turntable rotation period, the microcomputer 12 calculates a summation and averages the data detected during the 1 turntable rotation period (step S33).

Next, by subtracting the characteristic data about the output power characteristics of the magnetron 18 and the energy absorption in the cooking chamber of the microwave oven from the data detected by the cooking status detecting sensor 6, the microcomputer 12 outputs the characteristic data about the physical status change of food only (step S34).

The microcomputer 12 determines the type of food and the physical status change of the food in the microwave oven by comparing the characteristic data about the physical status change of food only with the preset tabled data about the food and physical status change stored in the preset data memory 12A, so as to obtain the most approximate value to the data about the physical status change of food only (step S35).

As described above, according to the present invention, when cooking the food in the cooking chamber of the microwave oven, the microcomputer determines the type of food and physical status change of the food by averaging the data regularly detected from the food during a certain rotation period of the turntable, on which the food is placed, and also obtains the characteristic data about the food itself by subtracting characteristics of the output power of the magnetron 18, and the energy absorption in the cooking chamber of the microwave oven. Accordingly, the cooking status and characteristics of the food can be precisely analyzed, and the most proper cooking can be achieved.

Further, since the microcomputer can analyze the type of food and the physical status change of the various foods, a plurality of cooking item buttons and complicated cooking algorithm corresponding to the key input of the cooking item buttons are no longer required to meet the demands for various cooking foods and cooking items. Accordingly, the manufacturing cost is significantly reduced.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. A method for operating a magnetron powered microwave oven, said method comprising the steps of:

(a) detecting data relative to a food from a sensor;

(b) subtracting data relative to characteristics of the microwave oven, which are prestored in the microwave oven, from the detected data to obtain modified detected data; and (c) controlling the output power of the magnetron by utilizing the modified detected data to determine a type and a status of the food.

2. The method of claim 1, wherein the data from the sensor comprise data which are detected during every 1 rotation period of a turntable of the microwave oven.

3. The method of claim 1, wherein the data relative to the characteristics of the microwave oven comprise data relative to at least one of characteristics of output power of the magnetron of the microwave oven and an energy absorption characteristic in a cooking chamber of the microwave oven.

4. A method for operating a magnetron powered microwave oven, said method comprising the steps of:

(a) detecting data relative to a food for a predetermined time period;

(b) calculating a summation of the detected data;

(c) subtracting data relative to characteristics of the microwave oven, which are prestored in the microwave oven, from the summation of the detected data to obtain modified detected data; and (d) controlling the output power of the magnetron by utilizing the modified detected data to determine a type and a status of the food.

5. The method of claim 4, wherein the data relative to the characteristics of the microwave oven comprise data relative to at least one of characteristics of output power of the magnetron of the microwave oven and an energy absorption characteristic in a cooking chamber of the microwave oven.

6. A microwave oven, comprising:

a magnetron for supplying microwave energy for food placed within the oven;

means for detecting data relative to the food from a sensor;

means for subtracting data relative to characteristics of the microwave oven, which are prestored in the microwave oven, from the detected data to obtain modified detected data; and means for controlling the output power of the magnetron by utilizing the modified detected data to determine a type and a status of the food.

7. The microwave oven of claim 6, wherein the data from the sensor comprise data which are detected during every 1 rotation period of a turntable of the microwave oven.

8. The microwave oven of claim 6, wherein the data relative to the characteristics of the microwave oven comprise data relative to at least one of characteristics of output power of the magnetron of the microwave oven and an energy absorption characteristic in a cooking chamber of the microwave oven.

9. A microwave oven, comprising:

a magnetron for supplying microwave energy for food placed within the oven;

means for detecting data relative to the food for a predetermined time period;

means for calculating a summation of the detected data, means for subtracting data relative to characteristics of the microwave oven, which are prestored in the microwave oven, from the summation of the detected data to obtain modified detected data; and means for controlling the output power of the magnetron by utilizing the modified detected data to determine a type and a status of the food.

10. The microwave oven of claim 9, wherein the data relative to the characteristics of the microwave oven comprise data relative to at least one of characteristics of output power of the magnetron of the microwave oven and an energy absorption characteristic in a cooking chamber of the microwave oven.

11. A method of processing food in a magnetron powered microwave oven, said method comprising the steps of:

(a) placing the food in a cooking chamber of the microwave oven;

(b) starting a processing of the food with a predetermined magnetron power output;

(c) detecting sensor data over a predetermined period;

(d) subtracting data relative to characteristics of the microwave oven from the detected sensor data to obtain modified detected sensor data;

(e) determining a physical status of the food based only on the modified detected sensor data; and (f) continuing to process the food based on the physical status of the food determined in preceding step (e).

12. The method of claim 11, wherein the characteristics of the microwave oven used in step (d) comprise at least one of magnetron output characteristics and cooking chamber energy absorption characteristics.

* * * * *